US006260700B1

(12) United States Patent
Huang

(10) Patent No.: US 6,260,700 B1
(45) Date of Patent: Jul. 17, 2001

(54) DETACHABLE SPARE-PARTS CONTAINER

(76) Inventor: Yao-Ju Huang, PO Box 82-144, Taipei (TW)

( * ) Notice: Subject to any disclaimer, the term of this patent is extended or adjusted under 35 U.S.C. 154(b) by 0 days.

(21) Appl. No.: 09/542,851

(22) Filed: Apr. 4, 2000

(51) Int. Cl.[7] ..... B65D 85/28
(52) U.S. Cl. ..... 206/373; 312/902; 206/372
(58) Field of Search ..... 206/372, 373–379, 206/523; 211/70.6; 312/330.1, 348.3, 902

(56) References Cited

U.S. PATENT DOCUMENTS 1,403,883 * 1/1922 Woods ..... 206/373
4,303,158 * 12/1981 Perkins ..... 206/373
5,788,072 * 8/1998 Chen ..... 206/372
5,826,719 * 10/1998 Chen ..... 206/373
5,857,757 * 1/1999 Bieker et al. ..... 206/373
5,915,554 * 6/1999 Hung ..... 206/372
6,105,769 * 8/2000 Chen ..... 206/373

* cited by examiner

*Primary Examiner*—Luan K. Bui
(74) *Attorney, Agent, or Firm*—A & J

(57) ABSTRACT

A detachable spare-parts container mountable with a tool container, comprising a body having a plurality of drawers to contain spare-parts and being slidable, the body being insertable to the tool container, characterized in that a plurality of holes are provided to the top section of the body and an urging block is protruded from the external end at the top section of the hole, and the drawer is at a box body slidably engaged at the hole, thereby various types and a larger number of spare-parts can be stored within the container.

1 Claim, 6 Drawing Sheets

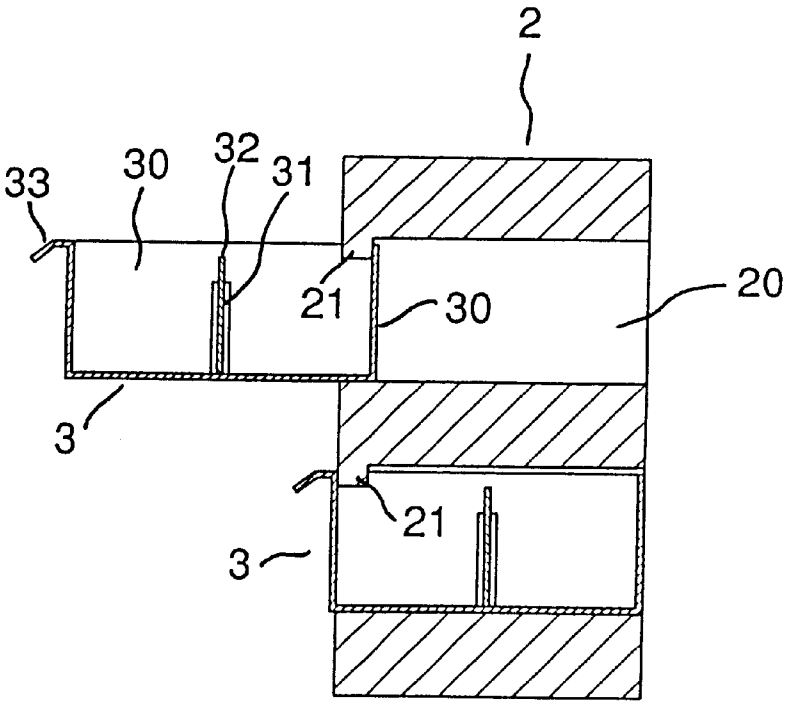
FIG. 6 B
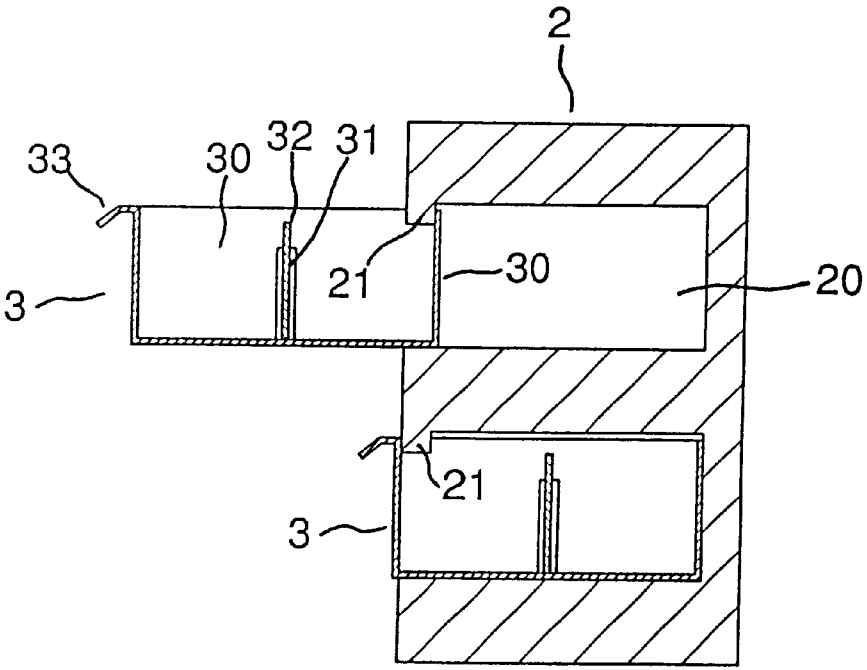
FIG. 6 A
FIG. 6

DETACHABLE SPARE-PARTS CONTAINER

BACKGROUND OF THE INVENTION a) Technical Field of the Invention

The present invention relates to a detachable spare-parts container, and in particular, to a container which is portable and can contain various types of, a relatively larger number and volume of spare-parts.

b) Description of the Prior Art

A tool box is normally used to contain tools and various types of spare-parts, such as nails, screws, nuts, pads, etc. Conventionally, when using a tool box, a plurality of containers are normally accompanied to the tool box to contain various types of the above spare-parts. As a result, it is rather inconvenient, and various types of spare-parts may be mixed up or incorrectly placed within the containers.

As shown in FIG. 1, the conventional structure is a tool box 1 having a box cover 10. The top of the box cover 10 is provided with one or a plurality of recesses 11 of appropriate area for the holding of spare-parts. The recess 11 is pivotally to a cover body 12, and is provided with a plurality of partition boards 13 so that the recess 11 can be partitioned into a plurality of chamber to hold various types of spare-parts.

Although the above conventional tool box is commonly used to hold spare-parts, it has the following drawbacks in application:

1) Containing very few types and number of spare-parts. As the area and depth of the recesses 11 are restricted by the tool box 1 and the partitioned chamber is limited, the type and number of the spare-parts are limited.
2) The change of spare-parts is troublesome. In the conventional tool box, the spare-parts are not easily changed after the spare-parts are placed within the box. In other words, the kind of spare-parts in the tool box is specific, and if other kind of spare-parts is needed, another tool box has to be prepared.
3) The spare-parts may mix-up or drop off from the box. As the recess 11 of the conventional box is rather shallow, the spare-parts therein may not closely in contact with the partition board as a result of vibration of the tool box. Thus, the spare-parts may be fallen over the partition board and mixed with other spare-parts in other partitioned chamber. In addition, if the box body 12 has not closed properly, the spare-parts may drop off from the tool box.

SUMMARY OF THE INVENTION

The present invention relates to a detachable spare-parts container, and in particular, to a container which is portable and can contain various types of, a relatively larger number and volume of spare-parts.

Accordingly, it is an object of the present invention to provide a detachable spare-parts container mountable with a tool container, comprising a body having a plurality of drawers to contain spare-parts and being slidable, the body being insertable to the tool container, characterized in that a plurality of holes are provided at the top section of the body and an urging block is protruded from the external end at the top section of the hole, and the drawer is at a box body slidably engaged at the hole, thereby various types and a larger number of spare-parts can be stored within the container.

BRIEF DESCRIPTION OF THE DRAWINGS

FIGS. 6A and 6B is a sectional view of another preferred embodiment of the tool box of the present invention.

DETAILED DESCRIPTION OF THE PREFERRED EMBODIMENT

Figure 1:
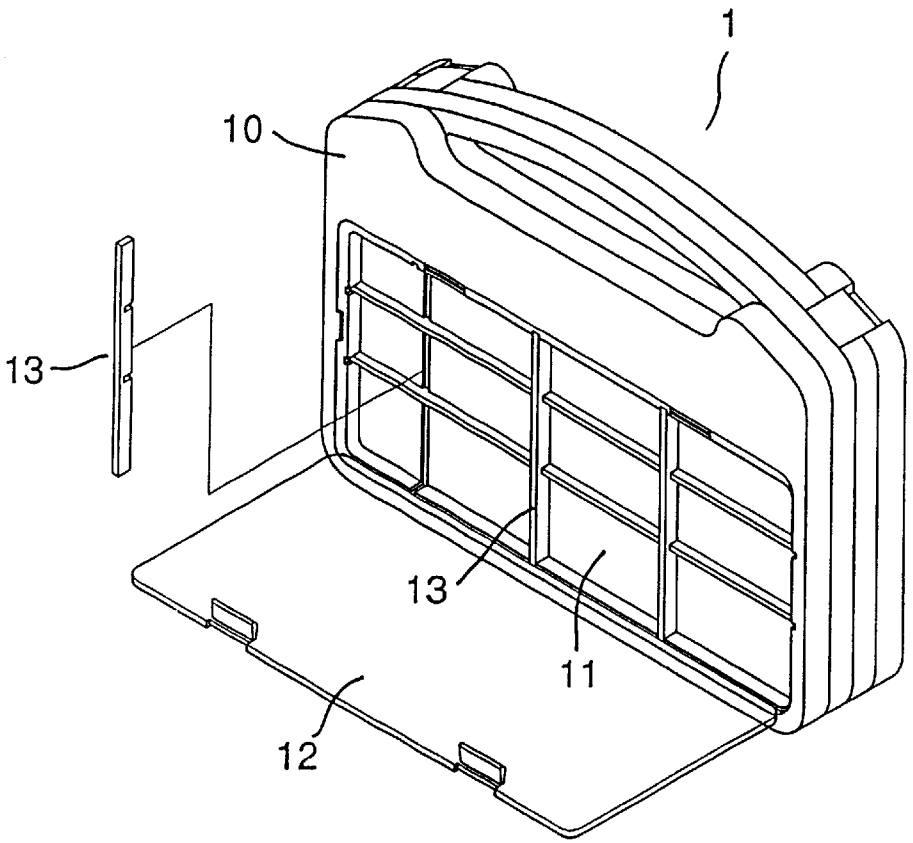
PRIOR ART FIG. 1
FIG. 1 is an exploded perspective view of a conventional tool box.
Figure 2:
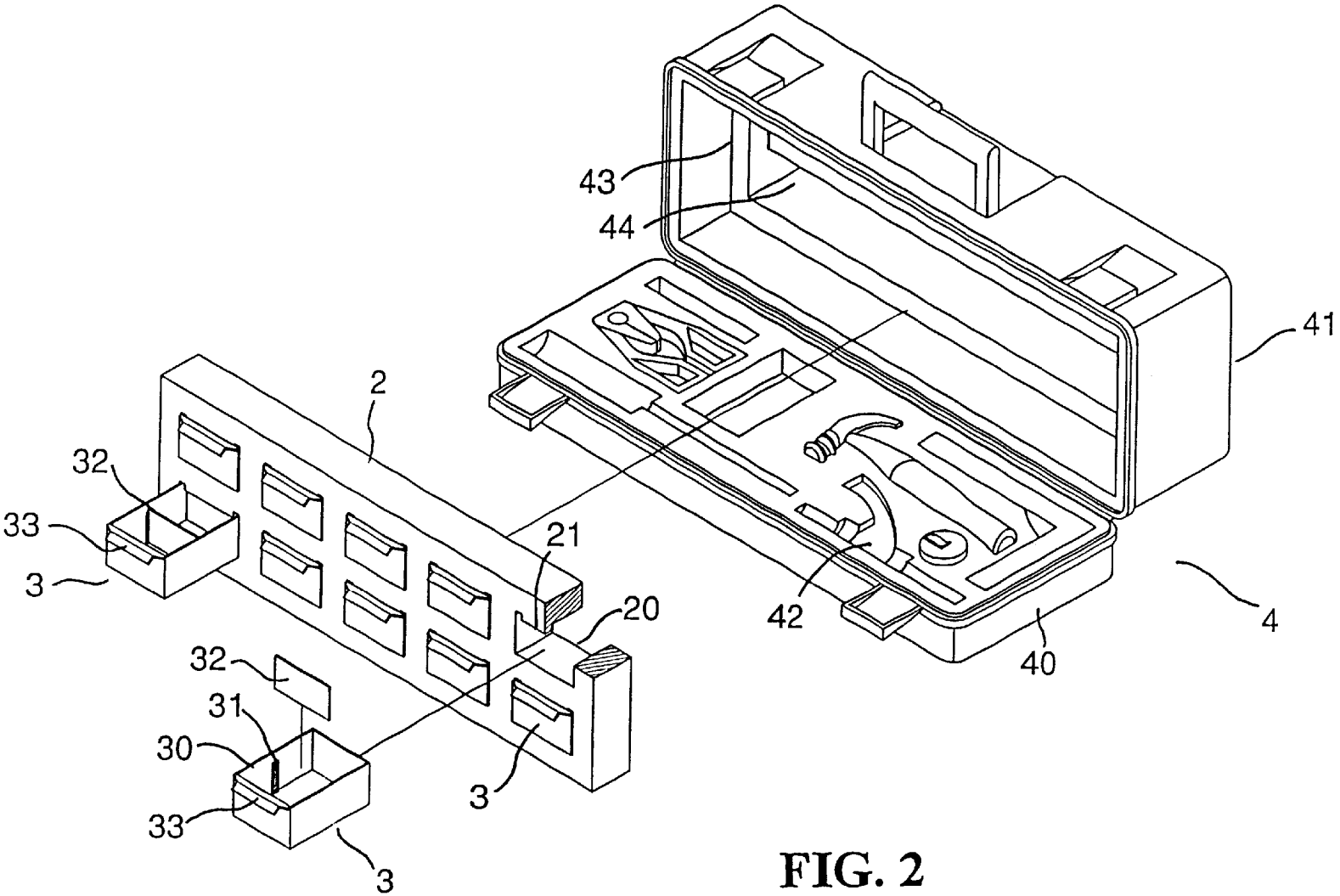
FIG. 2 is an exploded perspective view of a tool box in accordance with the present invention.
Figure 3:
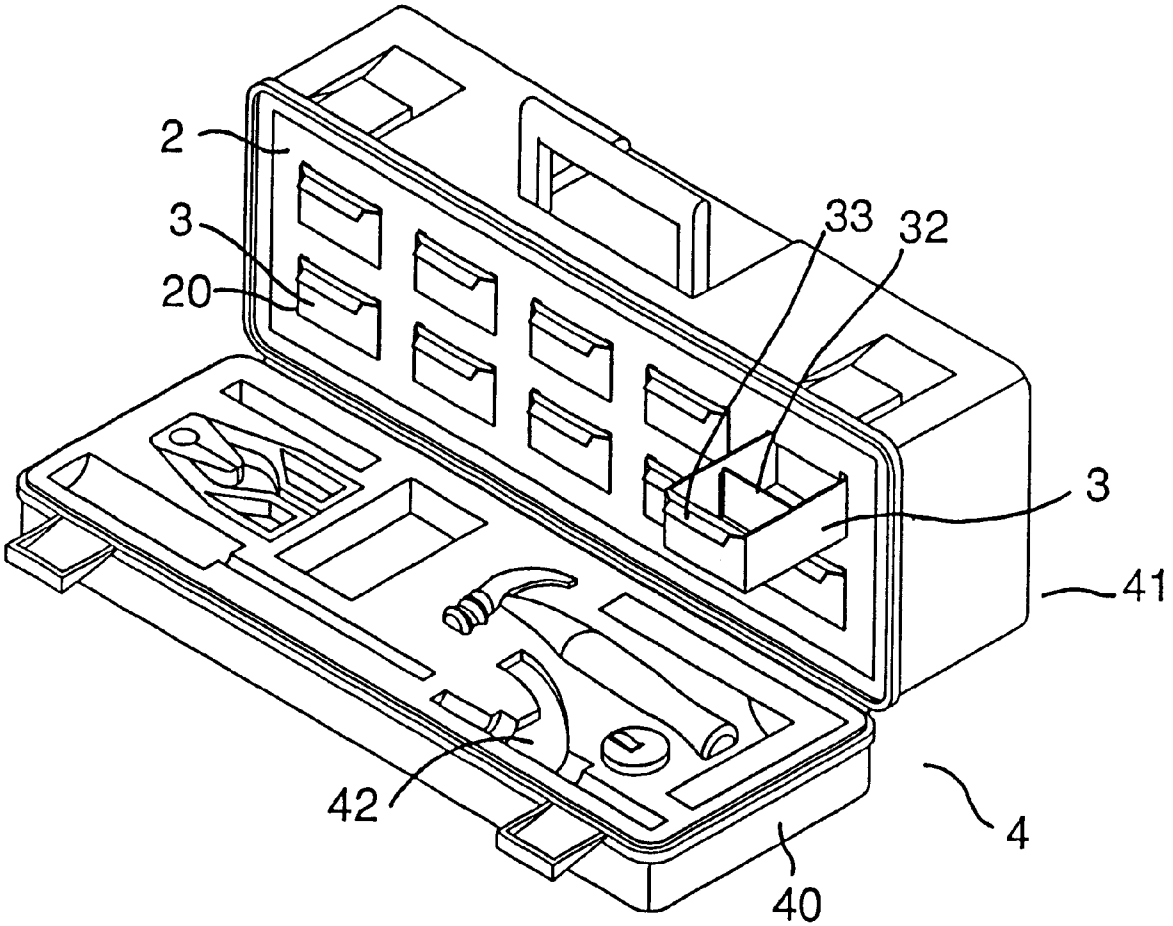
FIG. 3 is a schematic view showing an application of the tool box of the present invention.
Figure 4:
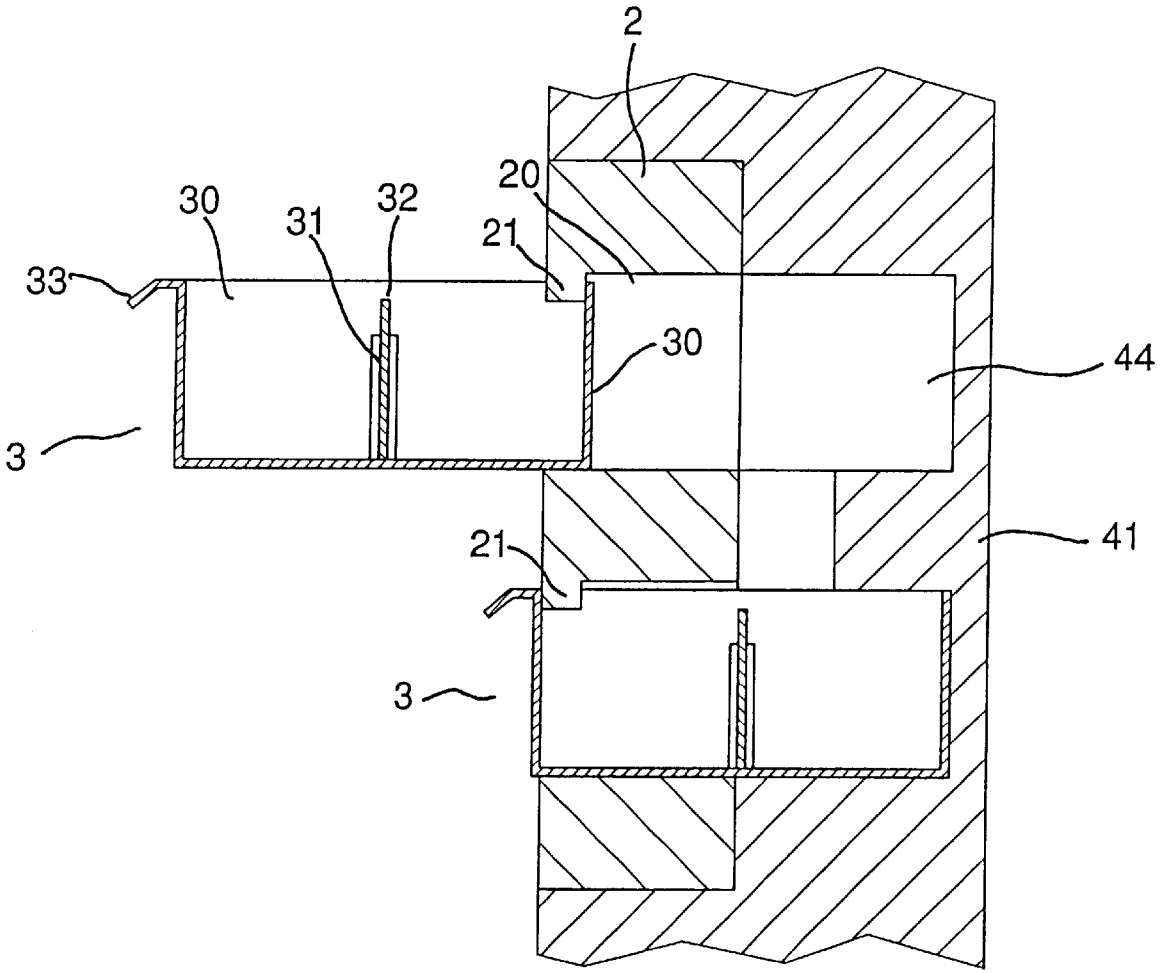
FIG. 4 is a sectional view of the tool box of the present invention.

Referring to FIGS. 2 to 4, there is shown a detachable spare-parts container structure which can be mounted onto a tool box or used independently as a tool container 4 for spare-parts, comprising a body 2 mounted with a plurality of drawers 3 which can be withdrawn therefrom.

In accordance with the present invention, the tool container 4 includes a box cover 40 and a box body 41. A plurality of engaging slots 42 are provided on the box cover 40 for holding tools. The box body 41 is provided with a step-like box edge 43 for the mounting of the body 2, and a plurality rows of passages 44 are provided within the box body 41 for the insertion of the back section of the drawers 3 so as to avoid vibration of the drawers 3.

The body 2 can be engaged onto the box body 41 of the tool container 4, and the top of the body 2 is provided with a plurality of rectangular holes 20. The external end at the top section of the hole 20 is provided with an urging block 21 to avoid the entire drawer 3 from being fully drawn out.

The drawer 3 is a box body which is slidable within the hole 20. The lateral side walls 30 of the drawer 3 are provided with a plurality of engaging recesses 31, and the recesses 31 are used to hold a partition board 32 so that the drawer 3 is partitioned into a plurality of chambers. The external edge of the front end of the drawer 3 is protruded and formed into a protruded edge 33 facilitating the pulling out of the drawer 3.

Referring to FIG. 3, when in use, the box cover 40 of the tool container 4 is opened, and the box body 40 can be turned vertically. Thus, the drawer 3 can be easily pulled out to obtain the spare-parts contained therein.

Figure 5:
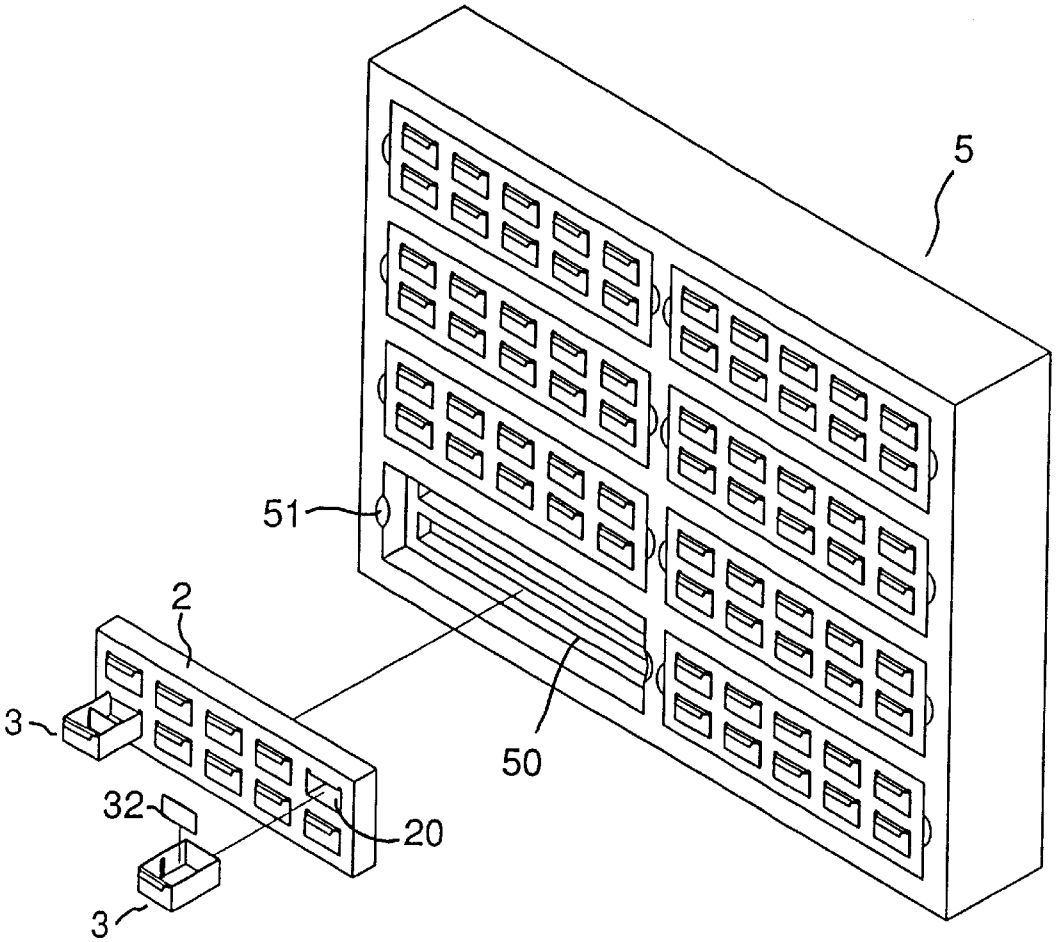
FIG. 5 is another preferred embodiment of another application of the tool box mounted to a spare-parts cupboard in accordance with the present invention.

Referring to FIG. 5, the present structure can be used together with a spare-parts cupboard 5. The spare-parts cupboard 5 is provided with a plurality of openings 50 to hold the body 2. The sides of the opening 50 are provided with a plurality of notches 51 to facilitate the drawing out of the body 2 from the opening 50. The unused spare-parts can be placed in the cupboard 5. When the spare-parts are needed, the spare-parts can be obtained from the cupboard 5, and place in the tool box 4 which can be carried along.

As shown in FIGS. 6A and 6B, the hole 20 of the body 2 can be a structure with an opened or sealed end which can fully cover the drawer 3 such that if the drawer 3 slides within the hole 20, the spare-parts within the drawer 3 will not drop off as a result of vibration of the drawer 3. As a result, the drawer 3 can be used independently or directly placed horizontally or vertically in any conventional tool box for carrying.

In accordance with the present invention, there are numerous advantages in application:

1) It can be used to contain various types, a greater number or volume of spare-parts.

As the body 2 can be engaged with a tool box 4 or a spare-parts cupboard 5, a plurality of drawers 3 are used to contain various types of spare-parts and these spare-parts can be classified differently. In addition, the drawer 3 has a bigger storage capacity and more spare-parts can be kept within the drawer.

2) The change of spare-parts is convenient.

The front end of the drawer is lifted and the drawer 3 can be withdrawn from the hole 20. The spare-parts within the drawer 3 are thus changed to other types of spare parts, and the drawer is then inserted back into the hole 20. Thus, it is convenient to change the spare-parts which are needed instead of carrying a further tool box containing the required.

3) The spare-parts will not easily mix up with each other or will not drop off easily.

As the drawer 3 containing the spare-parts is mounted within the hole 20 of the body 2, and the body 2 is provided at the tool box 4 or the spare-parts cupboard 5 or directly placed independently, the spare-parts will not drop off from the drawer 3.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. In a tool container having a box cover and a box body, said box cover being provided with a plurality of engaging recesses for holding tools, said box body being provided with a stepped edge, a plurality of rows of passages being provided within said box body, wherein a spare-parts container is detachably mounted on said stepped edge of said tool container, said spare-parts container comprising a body having a plurality of drawers to contain spare-parts, said rows of passages of said tool container are for insertion of back section of said drawers, a plurality of rectangular holes are provided to said body, an urging block is protruded from at external end at a top section of said holes for avoiding said drawers from being fully drawn out, said drawers being a box body which is slidable within said rectangular holes, two lateral side walls of said drawers are provided with a plurality of engaging recesses to hold a partition board so that the drawer is partitioned into a plurality of chambers, an external edge at a front end of said drawers is protruded with a protruded edge for facilitating withdrawing of said drawers, the spare-parts cupboard is provided with a plurality of openings to hold the body, and the sides of the opening is provided with a plurality of notches to facilitate the withdrawing of the body from the opening.

* * * * *